US006712289B1

(12) United States Patent
Ruehle et al.

(10) Patent No.: US 6,712,289 B1
(45) Date of Patent: Mar. 30, 2004

(54) FUEL INJECTION VALVE

(75) Inventors: Wolfgang Ruehle, Ditzingen (DE); Hubert Stier, Asperg (DE); Matthias Boee, Ludwigsburg (DE); Guenther Hohl, Stuttgart (DE); Norbert Keim, Loechgau (DE)

(73) Assignee: Robert Bosch GmbH, Stuttgart (DE)

( * ) Notice: Subject to any disclaimer, the term of this patent is extended or adjusted under 35 U.S.C. 154(b) by 375 days.

(21) Appl. No.: 09/889,226

(22) PCT Filed: Nov. 11, 2000

(86) PCT No.: PCT/DE00/04041

§ 371 (c)(1),
(2), (4) Date: Nov. 20, 2001

(87) PCT Pub. No.: WO01/36808

PCT Pub. Date: May 25, 2001

(30) Foreign Application Priority Data

Nov. 12, 1999 (DE) ..... 199 54 537

(51) Int. Cl.[7] ..... B05B 1/08

(52) U.S. Cl. ..... 239/102.2; 239/533.9; 251/335.3; 267/122

(58) Field of Search ..... 239/102.2, 102.1, 239/533.2, 533.11, 585.1–585.5; 251/129.06, 335.3; 123/498, DIG. 5; 310/327, 326; 267/122, 129, 152, 153

(56) References Cited

U.S. PATENT DOCUMENTS

| | | | | |
|---|---|---|---|---|
| 4,803,393 A | | 2/1989 | Takahashi | |
| 5,205,492 A | * | 4/1993 | Khinchuk | 239/533.4 |
| 5,630,550 A | | 5/1997 | Kurishige et al. | |
| 6,424,078 B1 | * | 7/2002 | Heinz | 310/328 |

FOREIGN PATENT DOCUMENTS

| | | | |
|---|---|---|---|
| DE | 195 00 706 | | 7/1996 |
| EP | 1154152 A2 | * | 11/2001 |
| JP | 10-288121 | * | 10/1998 |

* cited by examiner

*Primary Examiner*—Dinh Q. Nguyen
(74) *Attorney, Agent, or Firm*—Kenyon & Kenyon

(57) ABSTRACT

A fuel injection valve, especially an injection valve for fuel injection systems of internal combustion engines, includes a piezoelectric or magnetostrictive actuator and a valve-closure member, which can be actuated by an actuator via a valve needle and interacts with a valve-seat surface to form a sealing seat. An intermediate piece is connected via a first flexible seal to a support plate; the support plate is connected via a second flexible seal to a driver at the valve needle; and the driver is connected via a third flexible seal to the intermediate piece, thereby creating a sealed hydraulic translation device.

10 Claims, 1 Drawing Sheet

FUEL INJECTION VALVE

BACKGROUND INFORMATION

A fuel injection valve is described in German Patent Application No. DE 195 00 706 A1.

The device for metering liquids and gases, described in German Patent Application No. DE 195 00 706 A1, in particular in fuel injection valves in internal combustion engines, has a hydraulic displacement amplifier for converting the actuator travel of a piezoelectric actuator into an increased stroke of a valve needle. To spatially integrate the displacement amplifier in the valve housing to give a small overall volume, the lifting piston of the displacement amplifier is provided with an end section that has a reduced diameter and projects into a recess in the working piston of the displacement amplifier. A disk spring lying in the amplifier chamber bordered by the pistons presses the working piston against the actuator, and a helical compression spring arranged in the recess concentrically to the end section presses the lifting piston against the valve needle.

Influences from temperature changes, wear, and manufacturing tolerances on the actuator displacement of the actuator are compensated for in that in each case a hollow-cylindrical restrictor gap, via which the amplifier chamber is linked to a liquid-filled low-pressure space, is provided on the guide surfaces of the pistons, between the pistons and between the pistons and the inside wall of the valve housing. The volume defined by the amplifier chamber, the restrictor gaps, and the low-pressure space is sealed.

In the case of the lifting device known from German Patent Application No. DE 195 00 706 A1, above all the costly construction and the overall length of the valve are disadvantageous. The relatively large volume and relatively large cross-sectional area of the actuator also do not allow for a particularly compact design. In addition, the large displacement volumes result in a high cavitation tendency in the restrictor gaps.

SUMMARY OF THE INVENTION

The fuel injection valve according to the present invention has the advantage that the lifting device is flexibly configured, and that the temperature is easily compensated in addition to translating and reversing lift.

The seals configured as corrugated tubes are flexible, so that linear deformations are compensated for.

In addition, the flexibility of the seals improves the dynamic performance of the fuel injection valve, since the flexible corrugated tubes prevent the valve-closure member from chattering on the valve-seat surface and, as such, largely prevent the fuel injection valve from opening again. The result is increased accuracy in the metering times and metering amounts.

As a result of the partial accommodation of the valve needle in the central recess of the actuator, the tube-shaped actuator allows for a particularly compact and light design of the fuel injection valve, a tube-shaped valve needle sealed with respect to a nozzle body being at the same time used for supplying fuel to the sealing seat.

DETAILED DESCRIPTION

Figure 1:
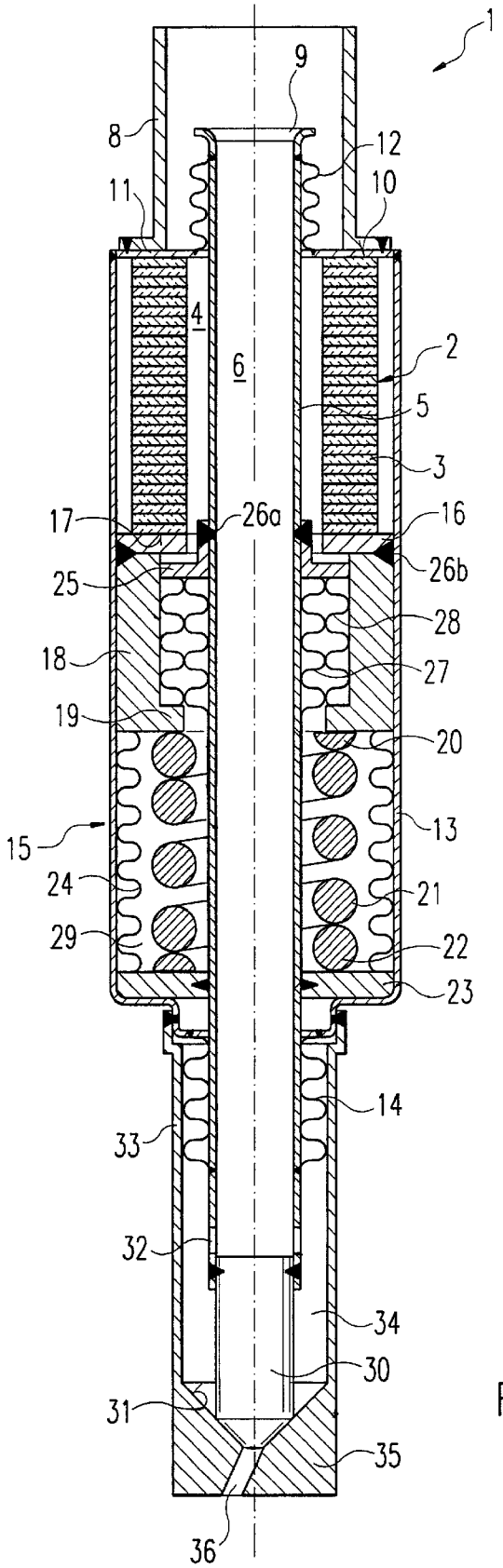
FIG. 1 shows an axial section of an exemplary embodiment of a fuel injection valve according to the present invention.

FIG. 1 shows an axial sectional view of an exemplary embodiment of a fuel injection valve 1 according to the present invention. In this context, fuel injection valve 1 is a fuel injection valve that opens towards the inside. Fuel injection valve 1 is particularly used to directly inject fuel into the combustion chamber of a mixture-compressing internal combustion engine having externally supplied ignition.

Fuel injection valve 1 includes an actuator 2, which is composed of disk-shaped piezoelectric or magnetostrictive elements 3 and has a tube-shaped design. Therefore, actuator 2 has a central recess 4, into which a valve needle 5 is inserted. Valve needle 5 has a tube-shaped design and is provided with a central recess 6, through which the fuel flows. The fuel is supplied via a connecting sleeve 8 into a nipple-shaped extension 9 of valve needle 5.

A first front end 10 of actuator 2 abuts on an actuator cover plate 11. Actuator cover plate 11 and valve needle 5 are connected to one another by a first fuel seal 12, which is designed as a corrugated tube in the exemplary embodiment. First fuel seal 12 seals an actuator housing 13 against the fuel, which is centrally supplied via connecting sleeve 8. A second fuel seal 14, which is also configured as a corrugated tube in the exemplary embodiment, seals actuator housing 13 in the spray direction. Second fuel seal 14 is welded to actuator housing 13 and valve needle 5.

A translation device 15 is enclosed in actuator housing 13. Translation device 15 includes an actuator base plate 16, which abuts on a second front end 17 of actuator 2. A tube-shaped intermediate piece 18, which is supported by a radial projection 19 on a first end 20 of a compression spring 21, is connected to actuator base plate 16 via a welded seam **26*b*. A second end 22 of compression spring 21 is supported on a support plate 23, which abuts on the inside on a shoulder of actuator housing 13. Intermediate piece 18 and support plate 23 are connected to one another by a first flexible seal 24**.

Actuator base plate 16 and intermediate piece 18 reach behind a driver 25, which has an L-shaped cross section and is fixedly connected via a weld seam **26*a* to valve needle 5. On the one side, driver 25 is connected, preferably via welding, by a second flexible seal 27 to support plate 23, and on the other side, by a third flexible seal 28 to radial projection 19 of intermediate piece 18. The three flexible seals 24, 27, and 28 are configured in the exemplary embodiment as corrugated tubes and enclose a pressure space 29 of translation device 15, which is filled with a hydraulic medium. Compression spring 21 is enclosed in pressure space 29**.

Valve needle 5 is connected in the spray direction to a valve-closure member 30, which forms a sealing seat with a valve-seat surface 31. The fuel is directed via transversely running channels 32 in valve needle 5 into an intermediate space 34 located between valve-closure member 30 and a nozzle body 33 and further to the sealing seat, where it is spray-discharged via at least one spray-discharge opening 36 formed in a valve-seat member 35.

Piezoelectric elements 3 of actuator 2 expand if an electrical voltage is applied to actuator 2. Since actuator 2 rests securely against actuator housing 13 via actuator cover plate 11, actuator 2 can only expand in the spray direction, thereby pressing actuator base plate 16 including intermediate piece 18, which is connected thereto in a friction-locked manner, in the spray direction. Intermediate piece 18 presses compression spring 21 further together, against the already existing prestress. As a result of intermediate piece 18 moving, the hydraulic medium sealed in pressure space 29 of translation device 15 is displaced, thereby moving driver 25 in the direction of the opening. Driver 25 has an operative connection to valve needle 5, which causes the valve needle to also move in the direction of the opening. Valve-closure member 30 lifts off of valve-seat surface 31, and the fuel is sprayed through spray-discharge opening 36, which is formed in valve-seat member 35.

It is possible for translation device 15 to reverse the direction of the actuator stroke due to the fast actuating speed of actuator 2. In this case, the hydraulic medium behaves incompressibly. The hydraulic medium being displaced results in a pulse transmission.

The present invention is not limited to the represented exemplary embodiment, but is also possible in the case of a plurality of other types of construction of fuel injection valves 1, particularly in the case of fuel injection valves 1 opening toward the outside.

What is claimed is:

1. A fuel injection valve comprising:

a valve-seat surface;

a valve-closure member interacting with the valve-seat surface to form a sealing seat;

a valve needle;

an intermediate piece;

an actuator for actuating the valve-closure member via the valve needle and for actuating the intermediate piece, the actuator being one of piezoelectric and magnetostrictive;

a driver for actuating the valve needle;

a support plate;

a first flexible seal connecting the intermediate piece to the support plate;

a second flexible seal connecting the support plate to the driver; and a third flexible seal connecting the driver to the intermediate piece.

2. The fuel injection valve according to claim 1, wherein the fuel injection valve is an injection valve for a fuel injection system of an internal combustion engine.

3. The fuel injection valve according to claim 1, wherein the first, second and third flexible seals, the intermediate piece, the driver and the support plate form a hermetically sealed pressure space of a hydraulic translation device.

4. The fuel injection valve according to claim 3, further comprising a compression spring situated in the pressure space, the pressure space being filled with a hydraulic medium.

5. The fuel injection valve according to claim 4, wherein a first end of the compression spring is supported on a radial projection of the intermediate piece and a second end of the compression spring is supported on the support plate.

6. The fuel injection valve according to claim 5, wherein the third flexible seal is connected to the radial projection of the intermediate piece.

7. The fuel injection valve according to claim 1, wherein the driver is fixedly connected to the valve needle by welding.

8. The fuel injection valve according to claim 1, wherein the first, second and third flexible seals are flexible corrugated tubes.

9. The fuel injection valve according to claim 1, wherein the actuator and the valve needle are tube-shaped, and the valve needle extends through the actuator.

10. The fuel injection valve according to claim 9, wherein fuel is supplied through the valve needle to the sealing seat, and further comprising an actuator housing and first and second flexible fuel seals, and wherein, with respect to the actuator housing, the valve needle is sealed on an intake end by the first flexible fuel seal and on a spray end by the second flexible fuel seal.

* * * * *